US011401872B2

(12) United States Patent
Higuchi et al.

(10) Patent No.: US 11,401,872 B2
(45) Date of Patent: Aug. 2, 2022

(54) THROTTLE DEVICE AND METHOD FOR MANUFACTURING THROTTLE DEVICE

(71) Applicants: DENSO CORPORATION, Kariya (JP); DENSO DAISHIN CORPORATION, Tokoname (JP)

(72) Inventors: Akira Higuchi, Kariya (JP); Kenichi Ishihara, Tokoname (JP)

(73) Assignees: DENSO CORPORATION, Kariya (JP); DENSO DAISHIN CORPORATION, Tokoname (JP)

( * ) Notice: Subject to any disclaimer, the term of this patent is extended or adjusted under 35 U.S.C. 154(b) by 0 days.

(21) Appl. No.: 17/338,405

(22) Filed: Jun. 3, 2021

(65) Prior Publication Data

US 2021/0285388 A1 Sep. 16, 2021

Related U.S. Application Data

(63) Continuation of application No. PCT/JP2019/048983, filed on Dec. 13, 2019.

(30) Foreign Application Priority Data

Dec. 18, 2018 (JP) ..... JP2018-236469

(51) Int. Cl.
*F02D 9/10* (2006.01)
*F02D 11/10* (2006.01)
(Continued)

(52) U.S. Cl.
CPC ..... *F02D 9/1065* (2013.01); *F02D 9/02* (2013.01); *F02D 9/08* (2013.01); *F02D 9/10* (2013.01);
(Continued)

(58) Field of Classification Search
CPC . F02D 9/1065; F02D 9/02; F02D 9/08; F02D 9/10; F02D 9/1035; F02D 9/104;
(Continued)

(56) References Cited

U.S. PATENT DOCUMENTS 4,867,122 A * 9/1989 Kono ..... B60K 28/16 123/396
5,429,090 A * 7/1995 Kotchi ..... F02D 9/02 123/396
(Continued)

FOREIGN PATENT DOCUMENTS

JP 11-310183 11/1999
JP 2003-120335 4/2003
JP 2009-299673 12/2009

*Primary Examiner* — Phutthiwat Wongwian
*Assistant Examiner* — Susan E Scharpf
(74) *Attorney, Agent, or Firm* — Nixon & Vanderhye P.C.

(57) ABSTRACT

A valve gear includes a gear portion configured to rotate by drive torque transmitted from an actuator, a boss portion provided on the gear portion and having a cylindrical outer wall, and one or more extension portions extending in an axial direction from the gear portion on a radial outer side of the boss portion. A coiled spring including a first hook provided at end portion on a gear portion side, and a second hook provided at end portion on an opposite side to the gear portion so that the first hook and the second hook are respectively locked to each other on opposite sides in a circumferential direction of the extension portion. A valve gear subassembly formed by assembling the valve gear and the spring is housed in a valve gear accommodating chamber of the body, and the second hook of the spring is locked to the body.

9 Claims, 9 Drawing Sheets

(51) Int. Cl.
*F02D 9/02* (2006.01)
*F02D 9/08* (2006.01)

(52) U.S. Cl.
CPC ..... *F02D 9/104* (2013.01); *F02D 9/107* (2013.01); *F02D 9/1035* (2013.01); *F02D 11/10* (2013.01); *F02D 2011/102* (2013.01)

(58) Field of Classification Search
CPC .... F02D 9/107; F02D 11/10; F02D 2011/102; F02D 9/108
See application file for complete search history.

(56) References Cited

U.S. PATENT DOCUMENTS 5,996,551 A * 12/1999 Schroder ..... F02D 9/02 123/337
6,263,898 B1 * 7/2001 Vanderveen ..... F02D 9/02 137/15.25
6,840,217 B2 * 1/2005 Meiwes ..... F02D 9/1065 123/400
6,863,259 B2 * 3/2005 Torii ..... F02D 11/10 251/305
6,918,374 B1 * 7/2005 Kurita ..... F02D 9/02 123/337
6,923,157 B2 * 8/2005 Torii ..... F02D 9/104 123/337
6,986,336 B2 * 1/2006 Tanimura ..... F02D 9/1065 123/343
7,152,581 B2 * 12/2006 Wayama ..... F02D 9/105 123/399
7,536,993 B2 * 5/2009 Tsukiji ..... F02D 9/1065 123/361
8,746,210 B2 * 6/2014 Nicholas ..... F02D 9/1065 123/396
9,388,734 B2 * 7/2016 Mayer ..... F16K 1/16
9,624,837 B2 * 4/2017 Abram ..... F02D 9/04
9,784,383 B2 * 10/2017 Suzuki ..... F16K 31/047
10,428,889 B2 * 10/2019 Higuchi ..... F16F 1/48
2013/0047941 A1 * 2/2013 Niwa ..... F02M 26/70 123/90.11
2013/0174807 A1 * 7/2013 Kado ..... F02D 9/1065 123/399
2020/0141511 A1 * 5/2020 Higuchi ..... F16K 1/221
2021/0054791 A1 * 2/2021 Ishihara ..... F02D 9/1065

* cited by examiner

THROTTLE DEVICE AND METHOD FOR MANUFACTURING THROTTLE DEVICE

CROSS REFERENCE TO RELATED APPLICATIONS

This application is a continuation application of International Patent Application No. PCT/JP2019/048983 filed on Dec. 13, 2019, which designated the U.S. and based on and claims the benefits of priority of Japanese Patent Application No. 2018-236469 filed on Dec. 18, 2018. The entire disclosure of all of the above applications is incorporated herein by reference.

TECHNICAL FIELD

The present disclosure relates to a throttle device and a method for manufacturing the throttle device.

BACKGROUND

In a throttle device configured to adjust an opening degree of a throttle valve provided in an intake passage, an extrapolated coil-shaped spring generates an urging force on a valve gear to which a drive torque is transmitted from an actuator so as to keep the opening degree of the throttle valve at a predetermined opening degree.

SUMMARY

An object of the present disclosure is to provide a throttle device and a method for manufacturing the throttle device for improving the assembling property of a valve gear and a spring to a body.

A throttle device of the present disclosure includes a body in which an intake passage is formed, a throttle valve provided in the intake passage and whose opening degree is adjusted, a shaft rotatably supported by the body and to which the throttle valve is fixed, an actuator configured to output drive torque, a valve gear, and a coiled spring.

The valve gear includes a gear portion configured to rotate by drive torque transmitted from an actuator, a boss portion provided on the gear portion and having a cylindrical outer wall, and one or more extension portions extending in an axial direction from the gear portion on a radial outer side of the boss portion so as to form integrally the gear portion, the boss portion, and the extension portion.

The spring is externally inserted into the outer wall of the boss portion of the valve gear. The spring including a first hook provided at an end portion on a gear portion side, and a second hook provided at an end portion on an opposite side to the gear portion so that the first hook and the second hook are respectively locked to each other on opposite sides in a circumferential direction of the extension portion.

A valve gear subassembly formed by assembling the valve gear and the spring is housed in a valve gear accommodating chamber of the body, and the second hook of the spring is locked to the body. The shaft is fixed to the boss portion of the valve gear.

BRIEF DESCRIPTION OF DRAWINGS

The above and other objects, features and advantages of the present disclosure will become more apparent from the following detailed description made with reference to the accompanying drawings. In the drawings.

DETAILED DESCRIPTION

Figure 1:
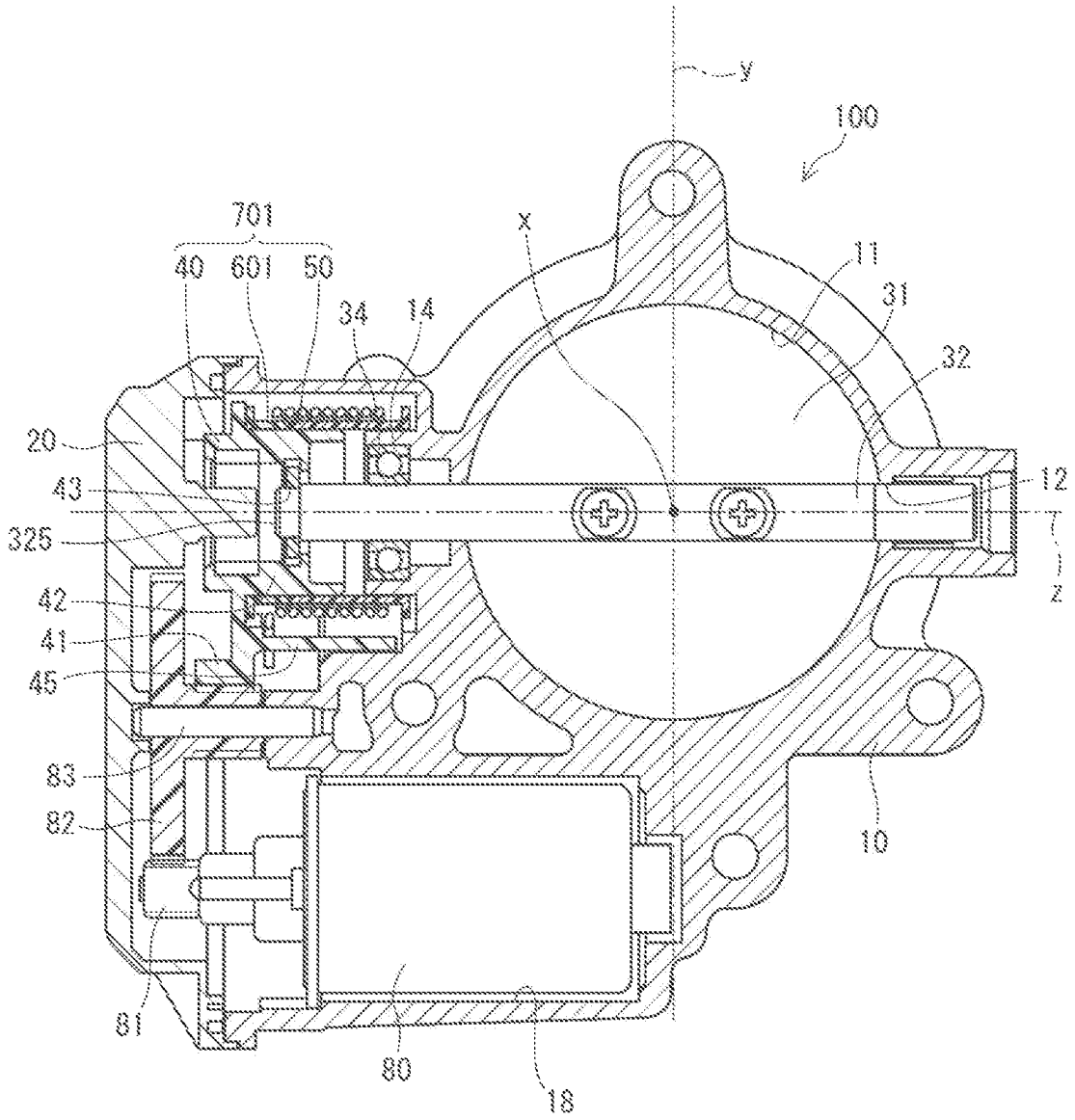
FIG. 1 is a cross-sectional view showing an overall configuration of a throttle device of a first embodiment.

In an assumable example, in a throttle device configured to adjust an opening degree of a throttle valve provided in an intake passage, an extrapolated coil-shaped spring generates an urging force on a valve gear to which a drive torque is transmitted from an actuator so as to keep the opening degree of the throttle valve at a predetermined opening degree. In a process of assembling the throttle device, when the valve gear and the spring are individually housed in a body, one of the two hooks formed at both ends of the spring is locked to the valve gear and the other is locked to the body. Then, after accommodating the valve gear and the spring in the body, it was necessary to temporarily assemble them with a shaft while adjusting their rotation positions.

Further, in the throttle device, a valve gear, a spring, and a guide, and a shaft are assembled to a protruding cylinder portion of a body. Since the hooks at both ends of the spring are accommodated in the protruding portion of the guide, a contact pressure between the hook and the body stopper is relaxed.

In the above example, it is necessary to assemble the guide and the spring after integrating the valve gear and the shaft. Therefore, the shaft needs to be aligned in a rotational direction so that the valve can be assembled, and the valve gear also needs to be aligned in the rotational direction with a position of the body stopper. Further, in order to set the spring at a predetermined position in the rotation direction, it is necessary to rotate and assemble the guide on the valve gear side and the hook of the spring in a state of being locked to the valve gear. Therefore, the assembly becomes complicated.

An object of the present disclosure is to provide a throttle device and a method for manufacturing the throttle device for improving the assembling property of a valve gear and a spring to a body.

A throttle device of the present disclosure includes a body in which an intake passage is formed, a throttle valve provided in the intake passage and whose opening degree is adjusted, a shaft rotatably supported by the body and to which the throttle valve is fixed, an actuator configured to output drive torque, a valve gear, and a coiled spring.

The valve gear includes a gear portion configured to rotate by drive torque transmitted from an actuator, a boss portion provided on the gear portion and having a cylindrical outer wall, and one or more extension portions extending in an axial direction from the gear portion on a radial outer side of the boss portion so as to form integrally the gear portion, the boss portion, and the extension portion.

The spring is externally inserted into the outer wall of the boss portion of the valve gear. The spring including a first hook provided at an end portion on a gear portion side, and a second hook provided at an end portion on an opposite side to the gear portion so that the first hook and the second hook are respectively locked to each other on opposite sides in a circumferential direction of the extension portion.

A valve gear subassembly formed by assembling the valve gear and the spring is housed in a valve gear accommodating chamber of the body, and the second hook of the spring is locked to the body. The shaft is fixed to the boss portion of the valve gear.

In the throttle device of the present embodiment, the first hook and the second hook of the spring are locked to the extension portion of the valve gear, and the valve gear subassembly is configured with the valve gear and the spring assembled. The operator accommodates the valve gear subassembly in the valve gear accommodating chamber of the body and locks the second hook of the spring to the body. After that, the operator crimps the tip portion of the shaft penetrating the shaft insertion hole of the boss portion, and fixes the shaft to the boss portion of the valve gear.

As a result, the spring in which the hooks at both ends are locked to the valve gear and the body generate an urging force so as to keep the opening degree of the throttle valve at a predetermined opening degree. In the present disclosure, it is not necessary to temporarily assemble the valve gear and the spring while adjusting the rotational positions of the valve gear and the spring after the body is housed in the body, and the ability of the assemble is improved. Further, unlike the conventional technique of Patent Document 1, the valve gear and the shaft are not integrated, so that the assembly is easy.

Further, the present disclosure is provided as a disclosure of a method for manufacturing the throttle device. The method for manufacturing the throttle device includes a valve assembly step, a subassembly step, an accommodating step, and a shaft fixing step, and has the same effect as the disclosure of the throttle device described above.

In the valve assembly step, the throttle valve and the shaft are assembled to the body. In the subassembly step, the valve gear and spring are assembled to form the valve gear subassembly. After the valve assembly and subassembly steps, in the accommodating step, the valve gear subassembly is housed in the valve gear accommodating chamber of the body and the second hook of the spring is locked to the body. After the accommodating step, in a shaft fixing step, the shaft is fixed to the boss portion of the valve gear in a state where the rotation position of the throttle valve is adjusted.

Hereinafter, a plurality of embodiments of the throttle device will be described with reference to the drawings. In the multiple embodiments, substantially the same components are denoted by the same reference numerals, and a description of the same components will be omitted. Further, the first to fourth embodiments are collectively referred to as "the present embodiment". The throttle device of the present embodiment adjusts an opening degree of a throttle valve provided in an intake passage of an internal combustion engine.

First Embodiment

The first embodiment will be described with reference to FIGS. 1 to 6. First, an overall configuration of a throttle device 100 will be described with reference to FIG. 1. In the throttle device 100, parts such as a throttle valve 31, a shaft 32, a valve gear 40, a spring 50, an actuator 80, and an intermediate gear 82 are assembled to a body 10 in which an intake passage 11 is formed, and a cover 20 is covered to the body 10. In the figure, a center of the intake passage 11 is defined as the x-axis, and a plane orthogonal to the x-axis, that is, the two axes orthogonal to each other on a paper surface of FIG. 1 is defined as the y-axis and the z-axis.

The throttle valve 31 is a disk-shaped butterfly valve, which is provided in the intake passage 11 to adjust an opening degree. The shaft 32 is rotatably supported along the z-axis by a shaft support portion 12 of the body 10 and a bearing 34 provided on a protruding cylinder portion 14 of the body 10, and the throttle valve 31 is fixed to the shaft 32. The valve gear 40 has a gear portion 41, a boss portion 42, an extension portion 45, and the like. A tip portion 325 of the shaft 32 is inserted into a shaft insertion hole 43 of the boss portion 42, and the shaft 32 is fixed to the valve gear 40. The detailed configuration of the valve gear 40 will be described later.

The actuator 80 such as a DC motor is housed in an actuator housing chamber 18 of the body 10 and outputs a drive torque. The intermediate gear 82 can rotate about a pin 83 supported by the body 10 and the cover 20, and reduces a rotation of an output gear 81 of the actuator 80 and transmits the rotation to the gear portion 41 of the valve gear 40. When the actuator 80 is rotated by energization, the valve gear 40 is rotated by the drive torque transmitted via the intermediate gear 82, and the shaft 32 and the throttle valve 31 fixed to the valve gear 40 are integrally rotated.

The spring 50 is extrapolated to an outer wall of the boss portion 42 of the valve gear 40, and generates an urging force in a twisting direction with respect to the drive torque so as to keep the opening degree of the throttle valve 31 at a predetermined opening degree. A guide 601 buffers a sliding between the valve gear 40 and the spring 50 as the valve gear 40 rotates. The detailed configuration of the spring 50 and the guide 601 will also be described later. Here, in the throttle device 100 of the present embodiment, a valve gear subassembly 701 formed by assembling the valve gear 40 and the spring 50 is housed in a valve gear accommodating chamber 13 (see FIG. 6) of the body 10.

Figure 2:
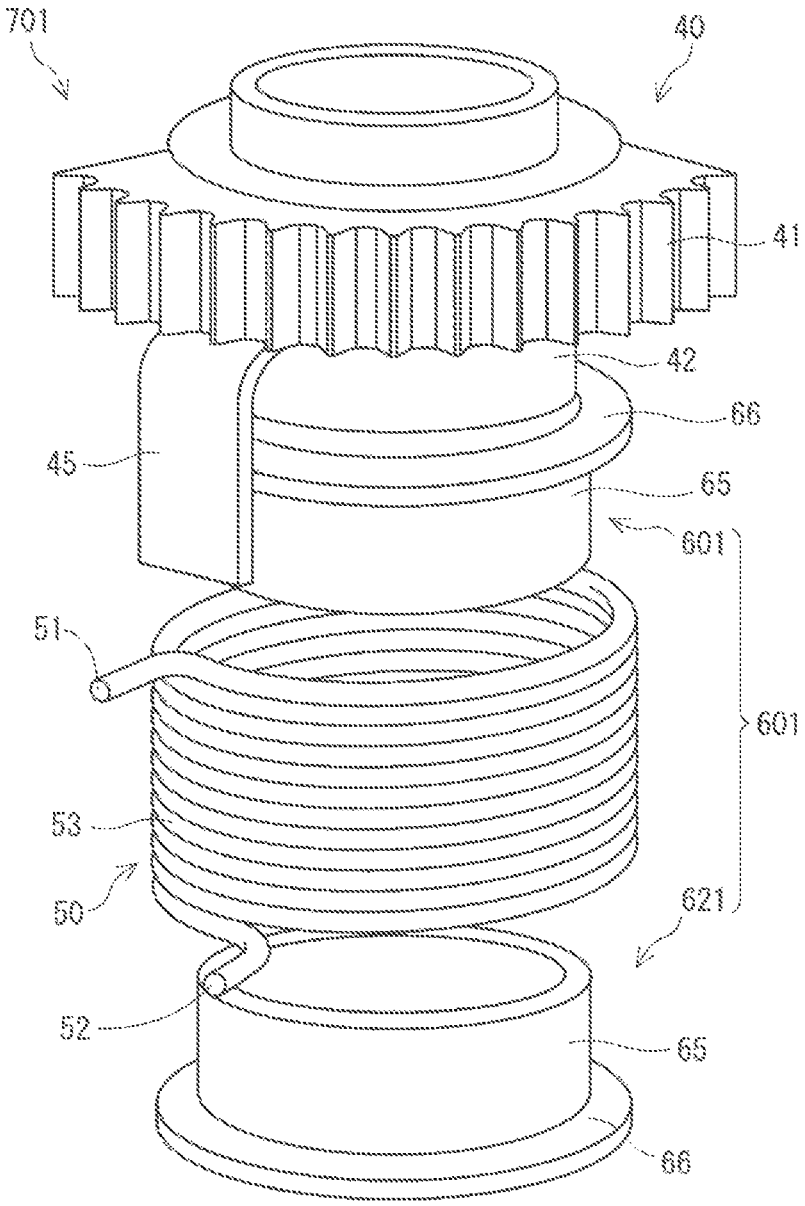
FIG. 2 is a perspective view of each component before assembling a valve gear subassembly of the first embodiment.
Figure 3:
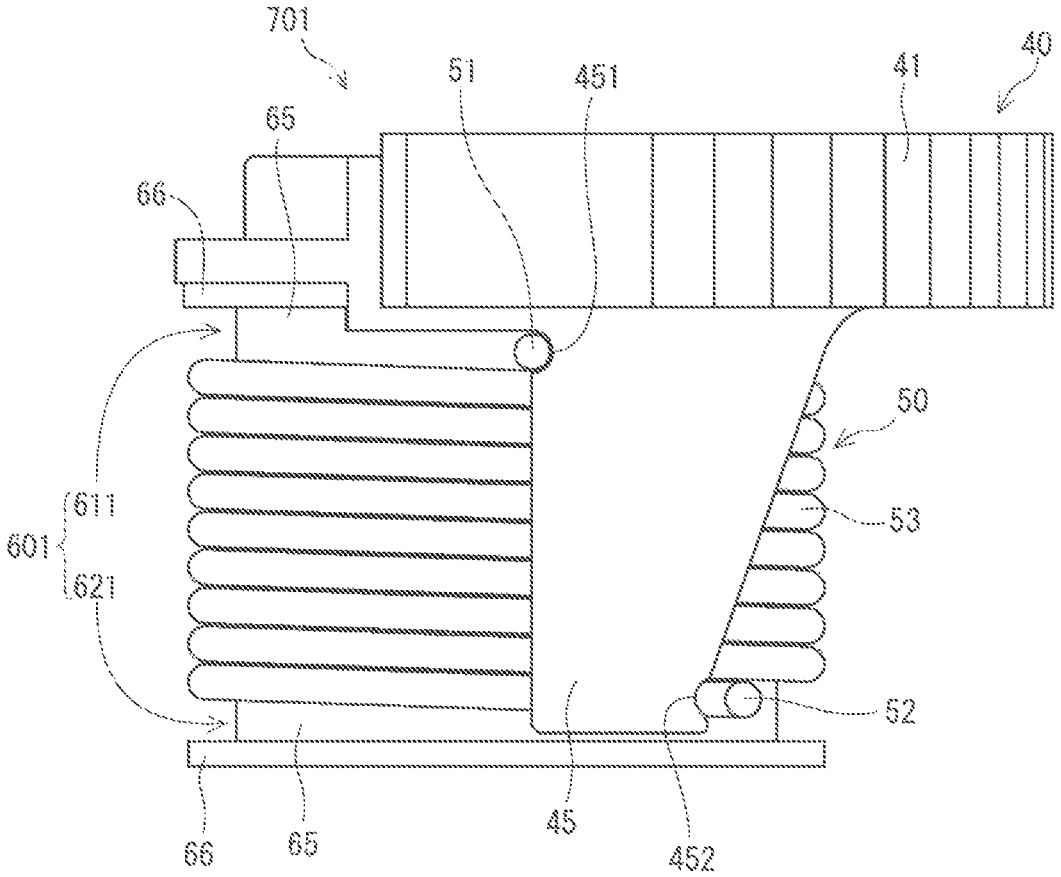
FIG. 3 is a schematic external view of the valve gear subassembly of the first embodiment.

Next, the configuration of the valve gear subassembly 701 of the first embodiment will be described with reference to FIGS. 2 to 4. FIG. 2 shows each part before assembling the valve gear subassembly 701. FIG. 3 schematically shows an appearance of the valve gear subassembly 701, and FIG. 4 schematically shows an axial cross section of the valve gear subassembly 701.

Figure 4:
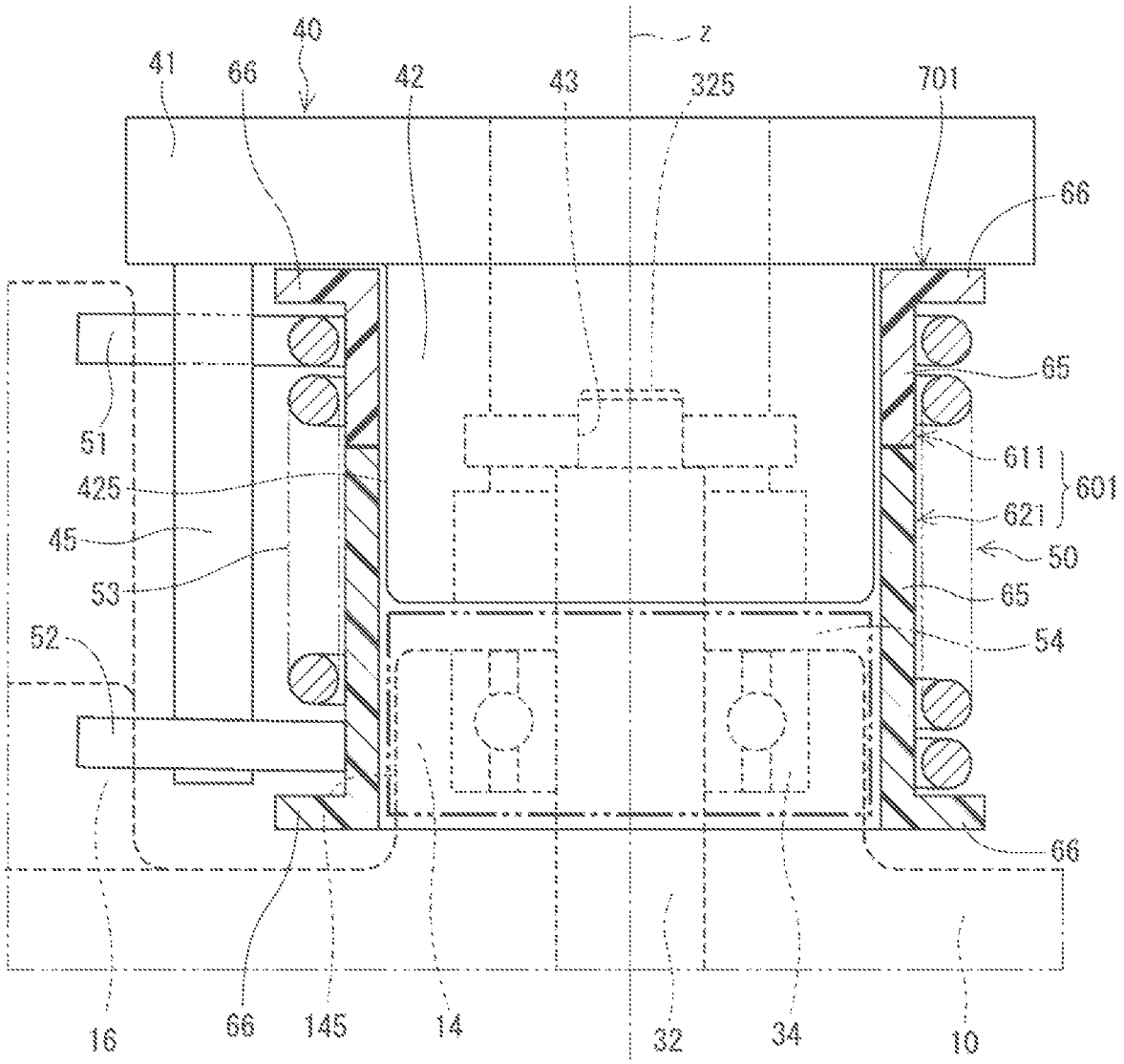
FIG. 4 is a schematic cross-sectional view of the valve gear subassembly of the first embodiment.

As shown in FIGS. 2 to 4, the valve gear subassembly 701 includes the valve gear 40, the spring 50 and the guide 601. In FIG. 4, the positions of the protruding cylinder portion 14, the shaft 32, and the bearing 34 of the body 10 are shown by broken lines in a state where the valve gear subassembly 701 is housed in the valve gear accommodating chamber 13 of the body 10.

The valve gear 40 is formed of a resin material such as PA6T (polyamide 6T), and the gear portion 41, the boss portion 42, and the extension portion 45 are integrally formed. The gear portion 41 rotates by the drive torque transmitted from the output gear 81 of the actuator 80 via the intermediate gear 82. In FIG. 4, the rotation axis of the gear portion 41 is designated as z. In the entire circumference of the gear portion 41, only about one-third of the entire circumference is actually formed with teeth, but the entire flat plate portion including the portion where teeth are not formed is referred to as the "gear portion 41".

The boss portion 42 is provided on the gear portion 41 and has a cylindrical outer wall 425. In the present embodiment, the boss portion 42 is provided coaxially with the rotation axis z of the gear portion 41. A shaft insertion hole 43 into which the tip portion 325 of the shaft 32 is inserted is formed inside the boss portion 42. The shaft insertion hole 43 may be formed of, for example, a metal member inserted into a resin. The tip portion 325 of the shaft 32 penetrates the shaft insertion hole 43 and is exposed to the gear portion 41 side so that it can be crimped from the gear portion 41 side.

In the present embodiment, since a length of the boss portion 42 is shorter than a height of the spring 50 and the guide 601, a fitting space 54 indicated by the thick alternate long and short dash line is formed in the portion where the boss portion 42 inside the spring 50 and the guide 601 does not exist. The fitting space 54 is a space in which the protruding cylinder portion 14 can be fitted when the valve gear subassembly 701 is accommodated in the valve gear accommodating chamber 13.

The extension portion 45 extends axially from the gear portion 41 on the radial outer side of the boss portion 42. As shown in FIG. 3, a first locking portion 451 for locking a first hook 51 of the spring 50 is provided on the left side in the drawing on a root side near the gear portion 41. Further, a second locking portion 452 for locking a second hook 52 of the spring 50 is provided on the right side in the drawing on a tip side far from the gear portion 41.

The first locking portion 451 and the second locking portion 452 receive the urging force of the spring 50. Therefore, as the material of the valve gear 40, PA6T or the like is selected as a material having strength against the drive torque and the spring load. In the perspective view of FIG. 2, the first locking portion 451 and the second locking portion 452 are not shown. Further, in FIG. 3, the outer diameter shape of the extension portion 45 is substantially trapezoidal, but in FIG. 2, it is simplified and described as a substantially rectangular shape.

The spring 50 is provided with the first hook 51 at the end of the coil body 53 on the gear portion 41 side in the axial direction. (Hereinafter, the reference numeral "41" is omitted and referred to as "gear portion side".) Further, a second hook 52 is provided at the end on the side opposite to the gear portion 41 in the axial direction (hereinafter, referred to as "counter gear portion side"). The coil body 53 is externally inserted into the outer wall 425 of the boss portion 42 of the valve gear 40. The first hook 51 and the second hook 52 are respectively locked on opposite sides of the extension portion 45 of the valve gear 40 in the circumferential direction.

When the valve gear subassembly 701 is housed in the valve gear accommodating chamber 13 of the body 10, the second hook 52 is locked to a body locking portion 16 shown by the broken line in FIG. 4. Further, by fixing the shaft 32 to the valve gear 40, the spring 50 generates an urging force so as to keep the opening degree of the throttle valve 31 at a predetermined opening degree.

The guide 601 is formed in a cylindrical shape as a resin material having good slidability, for example, PA (polyamide) containing PTFE (polytetrafluoroethylene). Since the guide 601 has a thin cylindrical shape, the volume of the guide 601 is smaller than the volume of the valve gear 40, and the amount of material used for molding in the guide 601 is small. Further, the guide 601 is divided into two, a first guide 611 and a second guide 621, in the axial direction. In the present embodiment, the first guide 611 on the gear portion side has a relatively short axial length, and the second guide 621 on the counter gear portion side has a relatively long axial length. However, the basic shapes of the first guide 611 and the second guide 621 are common.

Hereinafter, the common items of the first guide 611 and the second guide 621 will be described with the guide 601 as the subject. The guide 601 has a cylindrical guide main body 65 and a brim portion 66 projecting outward from the axial end portion of the guide main body 65. An outer diameter of the brim portion 66 is formed to be equal to or slightly larger than the outer diameter of the coil body 53 of the spring 50. The first guide 611 and the second guide 621 are shaped so that the ends of the guide main body 65 on the opposite side of the brim portion 66 are attached to each other.

The guide main body 65 of the first guide 611 is externally inserted in a range of about half of the outer wall 425 of the boss portion 42 on the gear portion side. Further, a portion of the guide main body 65 of the second guide 621 opposite to the brim portion 66 is externally inserted in a range of about half of the counter gear portion side. The portion of the first guide 611 and the second guide 621 that is externally inserted on the outer wall 425 of the boss portion 42 cushions the sliding of the boss portion 42 and the spring 50 due to the rotation of the gear portion 41. That is, since the guide 601 is interposed between the boss portion 42 and the spring 50, the valve gear 40 and the spring 50 do not slide directly, and the stress due to the sliding resistance is reduced.

The portion of the guide main body 65 of the second guide 621 on the brim portion 66 side is fitted to an outer wall 145 of the protruding cylinder portion 14 of the body 10. The above-described portion of the second guide 621 buffers the sliding of the protruding cylinder portion 14 and the spring 50 due to the twist of the spring 50. That is, since the guide 601 is interposed between the boss portion 42 and the spring 50, the body 10 and the spring 50 do not slide directly, and the stress due to the sliding resistance is reduced.

Figure 5:
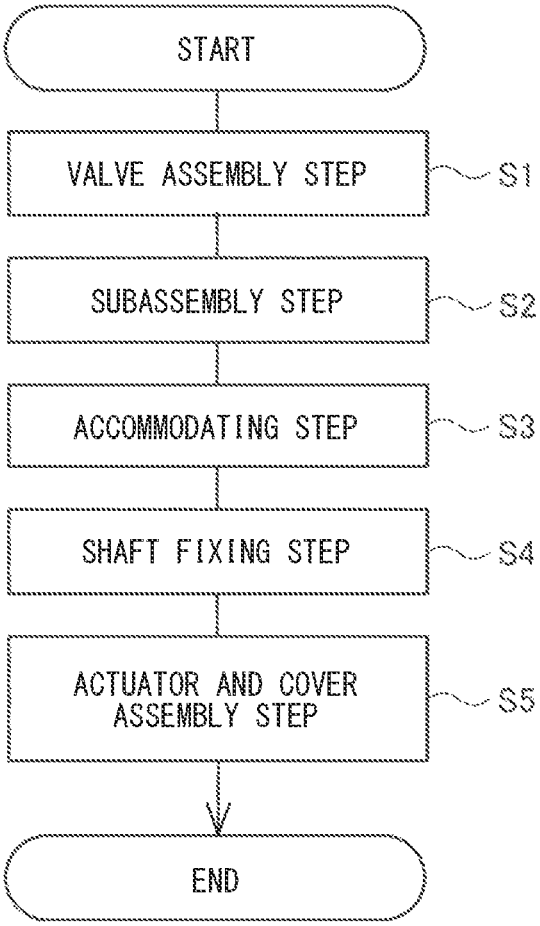
FIG. 5 is a flowchart of a method for manufacturing the throttle device according to the present embodiment.

Next, a method of manufacturing the throttle device 100 according to the present embodiment will be described with reference to the flowchart of FIG. 5 and FIG. 6. Hereinafter, in the flowcharts, a symbol S indicates step. In this flowchart, the process of accommodating the valve gear 40 and the spring 50 as subassemblies in the valve gear accommodating chamber 13 of the body 10 is mainly described. The assembly process and inspection process of other parts will be simplified or omitted.

In a valve assembly step S1, the throttle valve 31 and the shaft 32 are assembled to the body 10. FIG. 6 shows a state after the valve assembly step S1 and before the accommodating step S3. Specifically, the bearing 34 is held inside the protruding cylinder portion 14 of the body 10 and between the protruding cylinder portion 14 and an outer circumference of the shaft 32. Then, the throttle valve 31 arranged in the intake passage 11 and the shaft 32 rotatably supported by the body 10 are fixed by screws or the like.

In a subassembly step S2, the valve gear 40, the spring 50, and the guide 601 are assembled to form the valve gear subassembly 701 shown in FIGS. 2 to 4. The order of the valve assembly step S1 and the subassembly step S2 may be either first.

Figure 6:
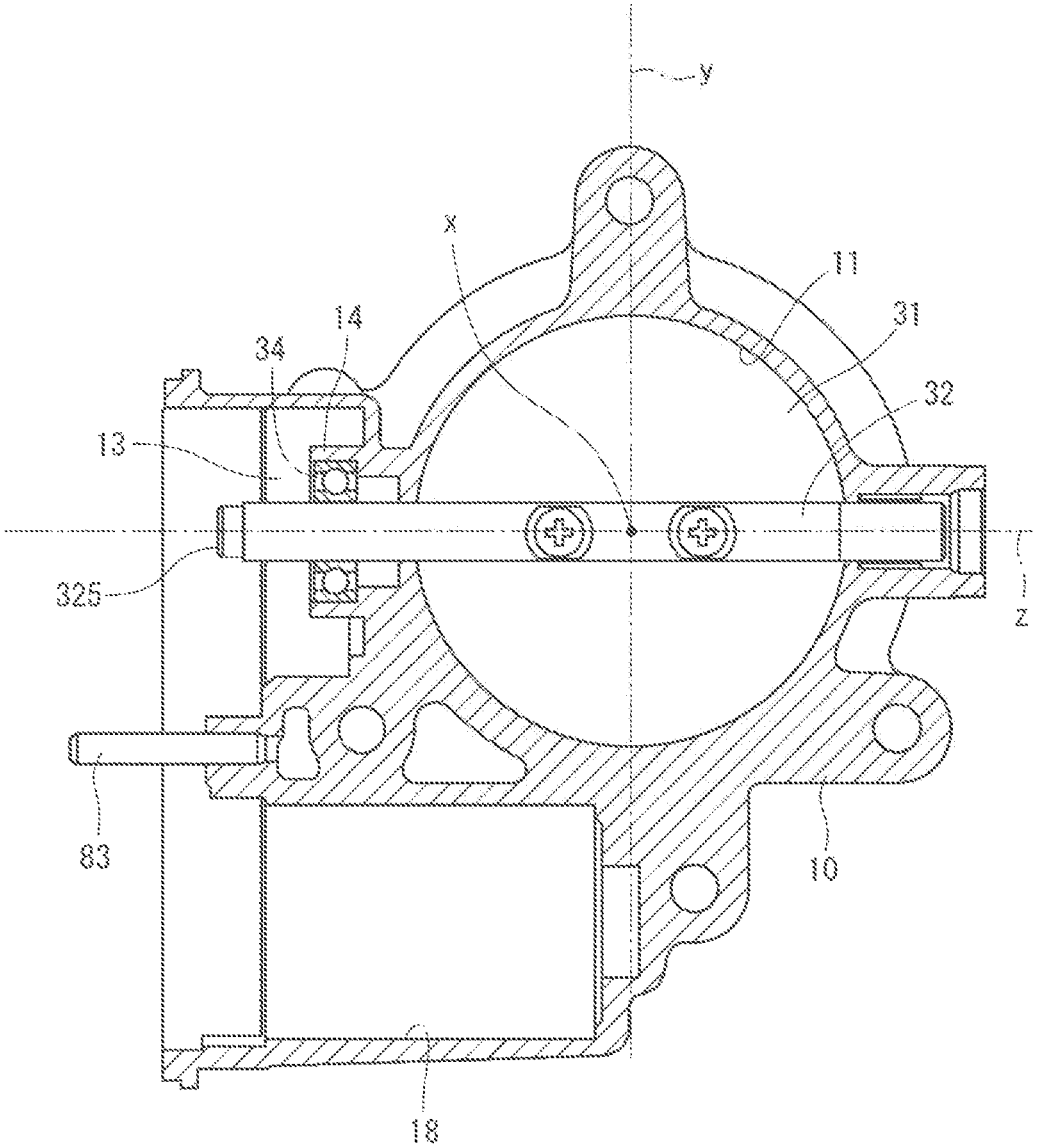
FIG. 6 is a cross-sectional view showing a state after a valve assembly process.

After the valve assembly step S1 and the subassembly step S2, in an accommodating step S3, the valve gear subassembly 701 is accommodated in the valve gear accommodating chamber 13 of the body 10 in the state shown in FIG. 6, and the second hook 52 of the spring 50 is locked to the body locking portion 16 of the body 10. At this time, the protruding cylinder portion 14 in which the bearing 34 is held inside fits into the fitting space 54 formed inside the spring 50 of the valve gear subassembly 701. In this way, the bearing 34 is held between the outer circumference of the shaft 32 and the protruding cylinder portion 14 at a position overlapping the spring 50 in the axial direction. Further, the tip portion 325 of the shaft 32 is inserted into the shaft insertion hole 43 of the boss portion 42 by gap fitting and penetrates to the gear portion 41 side.

After the accommodating step S3, in a shaft fixing step S4, the shaft 32 is connected to the boss portion 42 of the valve gear 40 in a state where the rotation position of the throttle valve 31 is adjusted. Specifically, for example, the tip portion 325 of the shaft 32 penetrating the shaft insertion hole 43 of the boss portion 42 is crimped.

After the shaft fixing step S4, in an actuator and cover assembly step S5, the actuator 80 is accommodated in the actuator accommodating chamber 18, the intermediate gear 82 is attached to the pin 83, and then the cover 20 is attached to the body 10. Details of the actuator and cover assembly step S5 will be omitted.

(Effects)

The effects of the throttle device 100 and the method of manufacturing the throttle device 100 of the first embodiment are described as follows.

(1) In the throttle device 100 of the present embodiment, since the first hook 51 and the second hook 52 of the spring 50 are locked to the extension portion 45 of the valve gear 40, the valve gear subassembly 701 is configured with the valve gear 40 and the spring 50 assembled. Then, after accommodating the valve gear subassembly 701 in the valve gear accommodating chamber 13 of the body 10, the operator crimps the tip portion 325 of the shaft 32 penetrating the shaft insertion hole 43 of the boss portion 42, for example, and then fixes the shaft 32 to the boss portion 42 of the valve gear 40.

As a result, it is not necessary to temporarily assemble the valve gear 40 and the spring 50 to the shaft 32 while adjusting the rotational positions of the valve gear 40 and the spring 50 after the body 10 is housed in the body 10, and the ability of the assemble is improved. Further, unlike the conventional technique of Patent Document 1 (JP 2003-120335 A), the valve gear and the shaft are not integrated, so that the assembly is easy.

(2) In the first embodiment, the guide 601 is further provided as a component of the valve gear subassembly 701. The guide 601 has the cylindrical guide main body 65 between the outer wall 425 of the boss portion 42 and the spring 50, and on the gear portion side in the axial direction, the sliding between the boss portion 42 and the spring 50 due to the rotation of the gear portion 41 is buffered. That is, since the guide 601 is interposed between the outer wall 425 and the spring 50, the valve gear 40 and the spring 50 do not slide directly, and the stress due to the sliding resistance is reduced. Further, on the counter gear portion side in the axial direction, similarly, the body 10 and the spring 50 do not slide directly, and the stress due to the sliding resistance is reduced.

In a form in which the valve gear 40 and the spring 50 or the body 10 and the spring 50 slide directly without the guide 601, it is necessary to form the valve gear 40 having a large volume with, for example, by using a material having good slidability containing, for example, PTFE and the material cost becomes high. On the other hand, in the first embodiment including the guide 601 it is sufficient to form only the guide 601 having a cylindrical shape and a small volume with a material having good slidability. Therefore, the material cost can be reduced.

(3) The guide 601 of the first embodiment is divided into two in the axial direction, the first guide 611 on the gear portion side and the second guide 621 on the anti-gear portion side. As a result, the first guide 611 and the second guide 621 can rotate following the twist of both ends of the spring 50 on the gear portion side and the counter gear portion side, respectively, so that the stress due to the sliding resistance can be reduced. Further, since the guide 601 has the brim portion 66, it is possible to regulate the positions of both ends in the axial direction of the spring 50 and prevent the spring 50 from falling off in the subassembly state.

(4) The valve gear subassembly 701 has the fitting space 54 inside the spring 50 into which the protruding cylinder portion 14 can be fitted when the valve gear subassembly 701 is accommodated in the valve gear accommodating chamber 13 of the body 10. As a result, the valve gear subassembly 701 and the bearing 34 held by the protruding cylinder portion 14 overlap in the axial direction, so that the space of the valve gear accommodating chamber 13 can be reduced.

Second Embodiment

Next, the second to fourth embodiments in which the structure of the guide in the valve gear subassembly is partially changed from the first embodiment will be described. The reference numerals of the guides and valve gear subassemblies of each embodiment are numbered by the third digit following "60" and "70", respectively. Further, the reference numerals of the first guide and the second guide in which the guides are divided into two are given the numbers of the embodiments in the third digit following "61" and "62".

Figure 7:
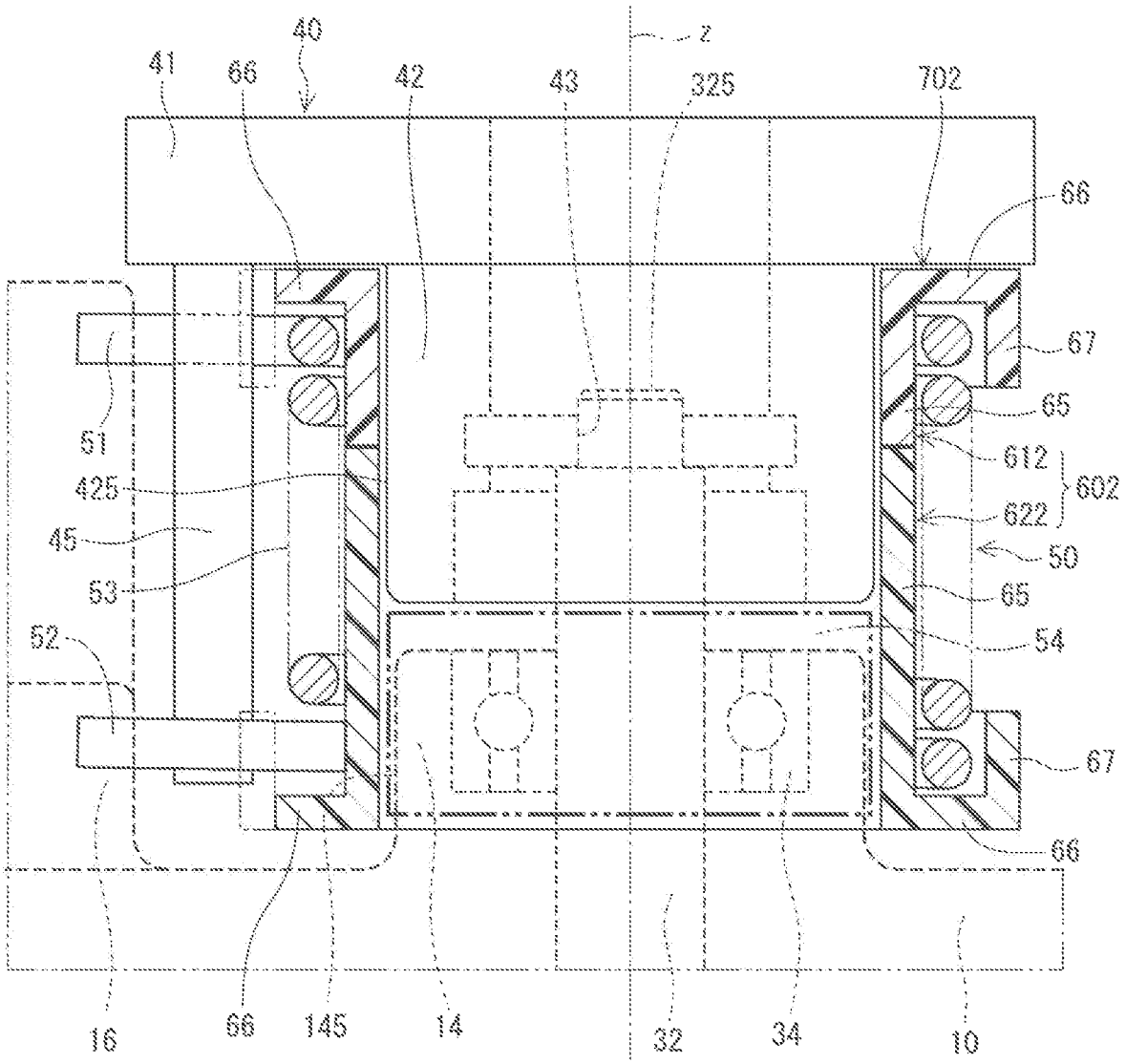
FIG. 7 is a schematic cross-sectional view of the valve gear subassembly of a second embodiment.

As shown in FIG. 7, in the valve gear subassembly 702 of the second embodiment, the guide 602 includes a first guide 612 and a second guide 622 divided into two in the axial direction. In addition to the brim portion 66, the first guide 612 and the second guide 622 have a side wall portion 67 extending from a peripheral edge of the brim portion 66 toward the central portion in the axial direction. As shown by the alternate long and short dash line on the left side of FIG. 7, the side wall portion 67 is removed at a position where it interferes with the first hook 51 and the second hook 52.

The side wall portion 67 guides the spring 50 from the outside, at least at the end in the axial direction. Therefore, the first guide 612 and the second guide 622 have a guide function of the spring 50 on both the inner and outer sides in the radial direction. In the embodiment shown in FIG. 7, the length of the side wall portion 67 is about 1 to 1.5 times the diameter of the spring wire, but the side wall portion 67 may be set to be longer.

Third Embodiment

Figure 8:
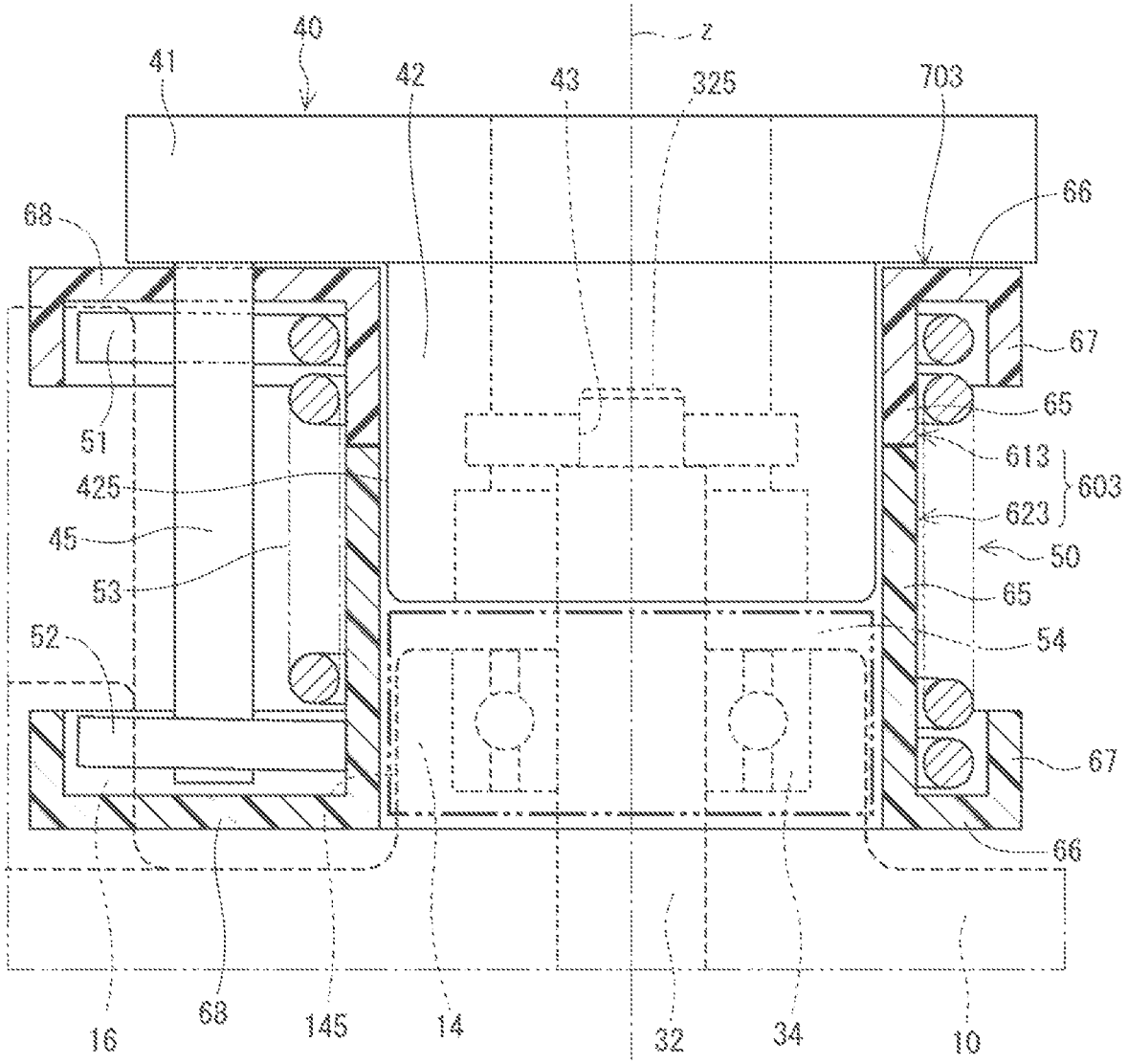
FIG. 8 is a schematic cross-sectional view of the valve gear subassembly of a third embodiment.

As shown in FIG. 8, in the valve gear subassembly 703 of the third embodiment, a guide 603 includes a first guide 613 and a second guide 623 which are divided into two in the axial direction. In addition to the brim portion 66 and the side wall portion 67, the first guide 613 and the second guide 623 project outward in the radial direction from the axial end portion of the guide main body 65 in a part in the circumferential direction, and have a hood portion 68 which covers the first hook 51 and the second hook 52. As a result, a contact area at the contact point between the second hook 52 and the body locking portion 16 increases, and the surface pressure decreases, so that the amount of wear of the body 10 decreases. Further, the gap between the second hook 52 and the body locking portion 16 at the initial rotation position is reduced, and rattling is suppressed.

Fourth Embodiment

Figure 9:
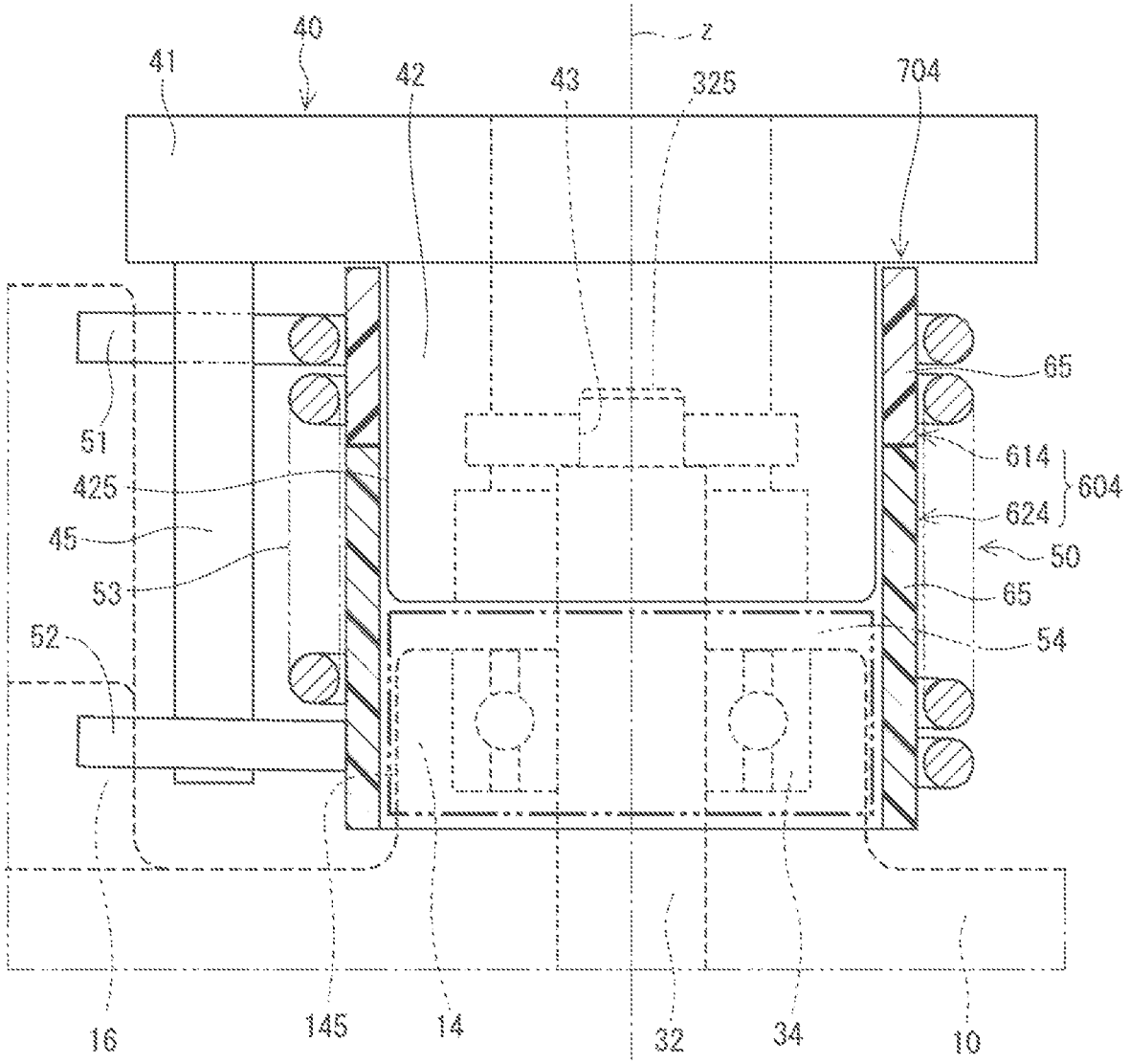
FIG. 9 is a schematic cross-sectional view of the valve gear subassembly of a fourth embodiment.

As shown in FIG. 9, in the valve gear subassembly 704 of the fourth embodiment, a guide 604 includes a first guide 614 and a second guide 624 which are divided into two in the axial direction. The first guide 614 and the second guide 624 are composed of only a cylindrical guide main body 65, and do not have the brim portion 66, a side wall portion 67, and a hood portion 68 as in the first to third embodiments. Even in this configuration, since the valve gear 40 and the spring 50 do not slide directly, it is not necessary to form the valve gear 40 with a material having good slidability, and the material cost can be reduced.

As a modification of the fourth embodiment, the brim portion 66 may be provided only at one end of the first guide or the second guide, and the brim portion 66 may not be provided at the other end. That is, one guide may have a brim portion 66. Similarly, at least one guide may have a side wall portion 67 and a hood portion 68. Further, the guide may not be divided into two, but may be formed into an integral cylindrical shape. Even if it is an integral guide, it is possible to buffer the sliding between the valve gear 40 and the spring 50 by forming it with a material having good slidability. By configuring the guide as one part, the number of parts can be reduced.

Other Embodiments (A) The first to fourth embodiments all include guides 601 to 604. However, when the demand for material cost reduction is low or when a material with good slidability can be obtained at low cost, the valve gear 40 can be formed from the material with good slidability without providing the guide.

(B) In the above embodiments, the first hook 51 is locked on one side of one extension portion 45 of the valve gear 40 in the circumferential direction, and the second hook 52 is locked on the other side of one extension portion 45 in the circumferential direction. In another embodiment, the valve gear 40 may be provided with a first extension portion in which the first hook 51 is locked and a second extension portion in which the second hook 52 is locked.

(C) In the above embodiments, since the length of the boss portion 42 of the valve gear 40 is shorter than the height of the spring 50, the fitting space 54 into which the protruding cylinder portion 14 can be fitted is formed in a portion where the boss portion 42 inside the spring 50 does not exist. However, the length of the boss portion 42 may be equal to or longer than the height of the spring 50, and the fitting space 54 may not be formed inside the spring 50. In this case, the protruding cylinder portion 14 of the body 10 and the spring 50 do not slide, and the sliding of the valve gear 40 and the spring 50 is buffered by the guide 601 or the like over the entire length of the spring 50.

Further, in this case, the bearing 34 is arranged at a position that does not overlap with the spring 50 in the axial direction. Even if the protruding cylinder portion 14 is fitted into the fitting space 54, the bearing 34 may be arranged at a position deep from the end surface of the protruding cylinder portion 14 and not overlapping with the spring 50 in the axial direction.

(D) The boss portion 42 may not be coaxial with the rotation axis z of the gear portion 41 but may be eccentric with respect to the rotation axis z. Further, the cylindrical outer wall 425 of the boss portion 42 may be substantially cylindrical as a whole, and may have grooves, protrusions, or the like formed on a part of the outer circumference or the inner circumference.

The present disclosure is not limited to the embodiment described above but various modifications may be made within the scope of the present disclosure.

The present disclosure has been made in accordance with the embodiments. However, the present disclosure is not limited to such embodiments and configurations. The present disclosure also encompasses various modifications and variations within the scope of equivalents. Furthermore, various combination and formation, and other combination and formation including one, more than one or less than one element may be made in the present disclosure.

What is claimed is:

1. A throttle device, comprising:

a body on which an intake passage is formed;

a throttle valve provided in the intake passage and whose opening degree is adjusted;

a shaft rotatably supported by the body and to which the throttle valve is fixed;

an actuator configured to output drive torque;

a valve gear includes a gear portion configured to rotate by the drive torque transmitted from the actuator, a boss portion provided on the gear portion and having a cylindrical outer wall, and one or more extension portions extending in an axial direction from the gear portion on a radial outer side of the boss portion so as to form integrally the gear portion, the boss portion, and the extension portion;

a coiled spring including a first hook extrapolated to the outer wall of the boss portion of the valve gear and provided at an end portion on a gear portion side, and a second hook provided at an end portion on an opposite side to the gear portion so that the first hook and the second hook are respectively locked to each other on opposite sides in a circumferential direction of the extension portion; and a guide having a cylindrical guide main body provided between the outer wall of the boss portion and an inner circumference of the spring, configured to buffer a sliding of the boss portion and the coiled spring due to rotation of the gear portion at least on the gear portion side in the axial direction, wherein a valve gear subassembly formed by assembling the valve gear, the spring and the guide is housed in a valve gear accommodating chamber of the body, and the second hook of the spring is locked to the body, the shaft is fixed to the boss portion of the valve gear, and the extension portion is tapered on a side where the second hook is locked.

2. The throttle device according to claim 1, wherein the guide is divided into two in the axial direction.

3. The throttle device according to claim 1, wherein the at least one guide has a brim portion that protrudes in a radial direction from an axial end portion of the guide main body.

4. The throttle device according to claim 3, wherein the at least one guide has a side wall portion extending from a peripheral edge of the brim portion toward a central portion in the axial direction and guiding the spring from an outside at at least the axial end portion.

5. The throttle device according to claim 1, wherein the at least one guide having a hood portion covering the first hook and the second hook of the spring and protruding outward from an axial end portion of the guide main body in a part in the circumferential direction.

6. The throttle device according to claim 1, wherein

The body is formed with a protruding cylinder portion protruding from a bottom portion of the valve gear accommodating chamber, the valve gear subassembly has a fitting space inside the spring into which the protruding cylinder portion is fitted when the valve gear subassembly is housed in the valve gear accommodating chamber, and a bearing is held inside the protruding cylinder portion at a position overlapping the spring in the axial direction with an outer circumference of the shaft.

7. The throttle device according to claim 1, wherein the extension portion includes a non-tapered side where the first hook is locked.

8. A method of manufacturing a throttle device including a body on which an intake passage is formed, a throttle valve provided in the intake passage and whose opening degree is adjusted, a shaft rotatably supported by the body and to which the throttle valve is fixed, an actuator configured to output drive torque, a valve gear includes a gear portion configured to rotate by the drive torque transmitted from the actuator, a boss portion provided on the gear portion and having a cylindrical outer wall, and one or more extension portions extending in an axial direction from the gear portion on a radial outer side of the boss portion so as to form integrally the gear portion, the boss portion, and the extension portion, a coiled spring including a first hook extrapolated to the outer wall of the boss portion of the valve gear and provided at an end portion on a gear portion side, and a second hook provided at an end portion on an opposite side to the gear portion so that the first hook and the second hook are respectively locked to each other on opposite sides in a circumferential direction of the extension portion, and a guide having a cylindrical guide main body provided between the outer wall of the boss portion and an inner circumference of the spring, configured to buffer a sliding of the boss portion and the coiled spring due to rotation of the gear portion at least on the gear portion side in the axial direction, the method comprising:

a valve assembly step in which the throttle valve and the shaft are assembled to the body;

a subassembly step in which the valve gear, the spring and the guide are assembled to form a valve gear subassembly;

an accommodating step in which the valve gear subassembly is housed in a valve gear accommodating chamber of the body, and the second hook of the spring is locked to the body, after the valve assembly step and the subassembly step; and a shaft fixing step in which the shaft is fixed to the boss portion of the valve gear in a state where a rotation position of the throttle valve is adjusted, after the accommodating step; wherein the extension portion is tapered on a side where the second hook is locked.

9. The method according to claim 8, wherein the extension portion includes a non-tapered side where the first hook is locked.

* * * * *